United States Patent [19]

Augustin

[11] Patent Number: 4,671,667

[45] Date of Patent: Jun. 9, 1987

[54] MOBILE MIXING DEVICE

[75] Inventor: Xavier Augustin, Nanterre, France

[73] Assignee: Technicatome Societe Technique Pour L'Energie Atomique, Paris, France

[21] Appl. No.: 773,119

[22] Filed: Sep. 6, 1985

[30] Foreign Application Priority Data

Sep. 13, 1984 [FR] France ..... 84 14064

[51] Int. Cl.[4] ..... B01F 7/16

[52] U.S. Cl. ..... 366/279; 366/273

[58] Field of Search ..... 366/198, 273, 274, 279, 366/331, 605

[56] References Cited

U.S. PATENT DOCUMENTS

| | | | |
|---|---|---|---|
| 1,463,744 | 7/1923 | Lauterbur | 366/198 |
| 1,598,399 | 8/1926 | Simmonds | 366/605 X |
| 1,598,400 | 8/1926 | Simmonds | 366/605 X |
| 2,967,433 | 1/1961 | Phillips | 366/331 X |
| 4,299,722 | 11/1981 | Stock . | |

FOREIGN PATENT DOCUMENTS

| | | |
|---|---|---|
| 0031879 | 7/1981 | European Pat. Off. . |
| 1104220 | 6/1955 | France . |
| 2055505 | 3/1981 | United Kingdom . |

*Primary Examiner*—Robert R. Mackey

[57] ABSTRACT

A mobile mixing device for at least two products coming from storage containers in barrels equipped with internal kneading means, which can be rotated by a kneading head, via a disconnectable coupling, wherein the device comprises a fixed stand having two receptacles able to receive the barrels and a turret supported by the stand, so that it can rotate about a vertical axis, said turret having the storage containers, the kneading head, at least one tube connecting each of the storage containers to the kneading head and means for vertically displacing the latter an upper position permitting a rotation of the turret in order to bring the said head successively above each of the barrels placed in the receptacles of the stand and a lower position in which the kneading means of the corresponding barrel are connected to the kneading head by said coupling.

6 Claims, 5 Drawing Figures

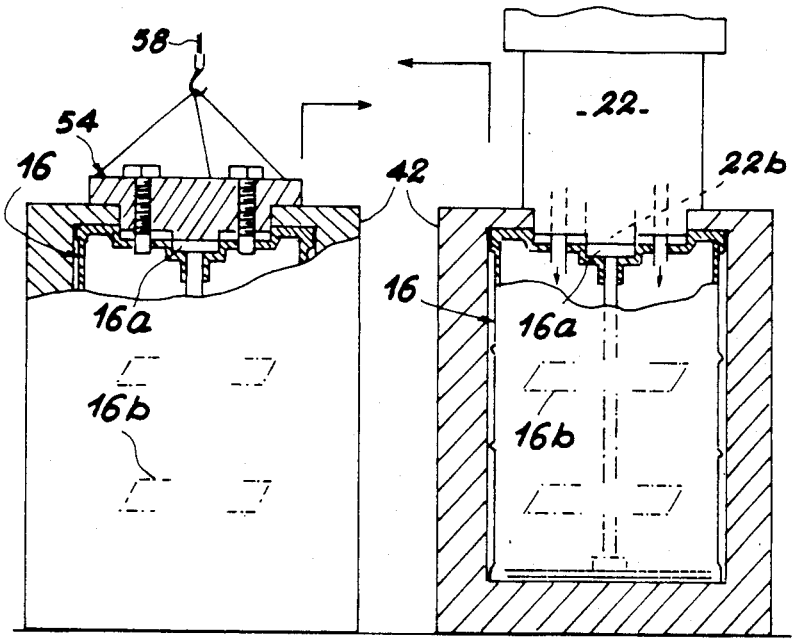
FIG. 4
FIG. 5
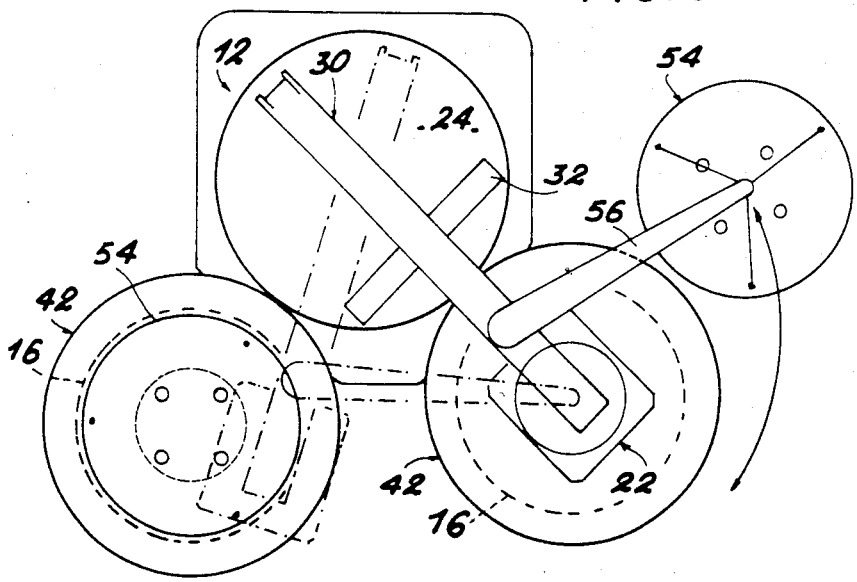

MOBILE MIXING DEVICE

BACKGROUND OF THE INVENTION

The present invention relates to a mobile device making it possible to mix at least two products coming from storage containers in barrels equipped with internal kneading means, which can be rotated by a kneading head, via a disconnectable coupling.

The invention is advantageously applied to the coating by an organic epoxy resin binder of solid particles, such as ion exchange resins obtained from the purification containers of primary circuits of pressurized water nuclear reactors and storage pools for fuels. However, the invention is not limited to this application and can be used in all cases, where the same products have to be successively mixed in several barrels or containers.

As is more particularly illustrated by French patent application No. 84 00543, filed on 3.1.1984 by Mr. Henri Lumpp for a "Device For Coating Particles", it is known in the field of particle coating to provide each of the barrels with internal stirring or kneading means, which can be remotely engaged and disengaged from a kneading head, which ensures both the introduction of the products to be mixed into the barrel and the rotation of the kneading means within the same. When stirring necessary for the coating is finished, the kneading head is disengaged from the internal kneading means and the latter are left preferably within the barrel.

In this known device, as in the case of mixing devices used in other technical fields and particularly in the chemical industry, mixing still takes place with a fixed station and the successive barrels to be filled are moved past the same. Particularly in the case of coating, this implies that the mixing or kneading station is preceded by dosing stations, where the dosing of the different products to be mixed takes place. The existence of these different stations obviously leads to large overall dimensions of the installation, which also is subject to high costs and requires a relatively large number of staff. Moreover, the increase in the number of stations and the movement of the barrels in front of the mixing station make it difficult to automate such an installation.

Moreover, when existing installations are intended for the treatment of dangerous or toxic products, they suffer from the disadvantage that the closure of the barrel only takes place at the following station and the complexity of the installations significantly increases the risks of leaks.

SUMMARY OF THE INVENTION

The present invention relates to a mobile mixing device in which the dosing of the products, the transfer of said products into the barrels, their mixing and optionally the sealing of the barrels take place in a particularly compact installation, which is successively moved alongside each of the barrels, whereof the costs and the number of staff are significantly reduced, which presents no leakage risk and which ensures a good protection for staff in the case of a speed of operation comparable to that of the best multistation machines.

The present invention therefore specifically relates to a mobile mixing device for at least two products coming from storage containers in barrels equipped with internal kneading means, which can be rotated by a kneading head, via a disconnectable coupling, wherein the device comprises a fixed stand having two receptacles able to receive the barrels and a turret supported by the stand, so that it can rotate about a vertical axis, said turret having the storage containers, the kneading head, at least one tube connecting each of the storage containers to the kneading head and means for vertically displacing the latter between an upper position permitting a rotation of the turret in order to bring the said head successively above each of the barrels placed in the receptacles of the stand and a lower position in which the kneading means of the corresponding barrel are connected to the kneading head by said coupling.

As a result of such a structure, the overall dimensions of the installation are five to six times smaller than those of a conventional multistation installation and the costs thereof are reduced by a factor of 2 or 3.

According to a special embodiment of the invention, the fixed stand comprises a base plate, in which are formed the receptacles and a cylindrical ferrule, whose vertical axis coincides with the rotation axis of the turret in which is received one of the containers. The turret is then preferably supported by the upper edge of the cylindrical ferrule and has a rotary cover sealing the ferrule and on which is suspended the container received in the latter.

According to another aspect of the invention, the kneading head is suspended on a support beam by a flexible fastening, on which act the means for vertically displacing the kneading head.

In order to permit a rapid sealing of the barrels as soon as mixing has taken place, the turret can also comprise means for handling a barrel cover making it possible to replace the kneading head by said cover when the head is disengaged from the corresponding barrel by a rotation of the turret. These barrel cover handling means e.g. comprise a second support beam pivotably supported about a vertical axis displaced towards the kneading head with respect to the rotation axis of the turret.

BRIEF DESCRIPTION OF THE DRAWINGS

The invention is described in greater detail hereinafter relative to non-limitative embodiments and the attached drawings, wherein:

FIG. 4 is a vertical sectional view diagrammatically showing the removal of the mixing head with respect to a barrel and the fitting of a plug thereon.

FIG. 5 is a plan view of the device very diagrammatically illustrating the removal of the mixing head and the fitting of a plug to the barrel.

DETAILED DESCRIPTION OF THE PREFERRED EMBODIMENTS

Figure 1:
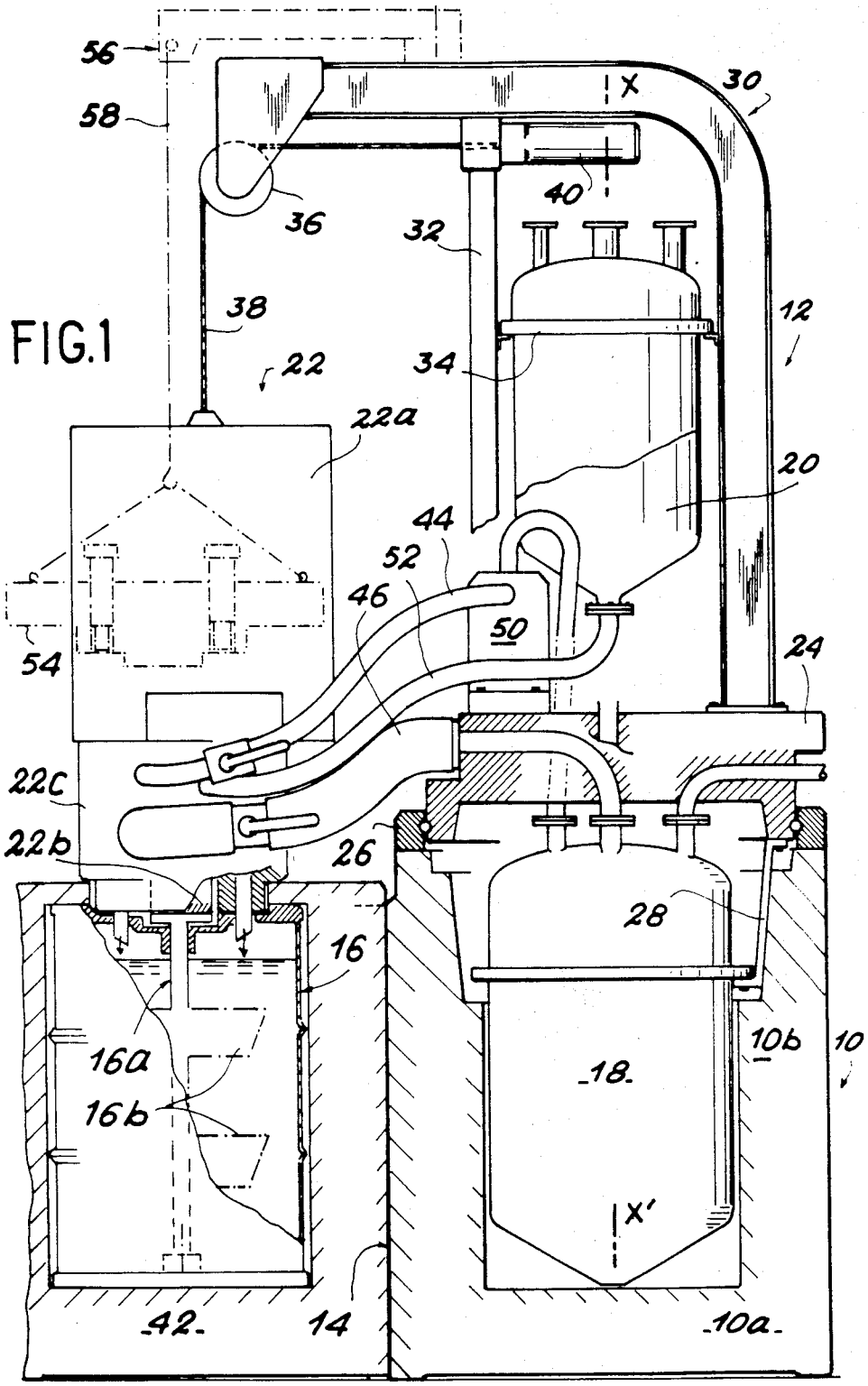
FIG. 1 is a side view, in partial section, of a mobile coating device according to the invention.

The mobile coating installation shown in FIG. 1 essentially comprises a fixed stand 10 and a mobile turret 12 supported by stand 10, so that it can turn about a vertical axis XX'.

Figure 2:
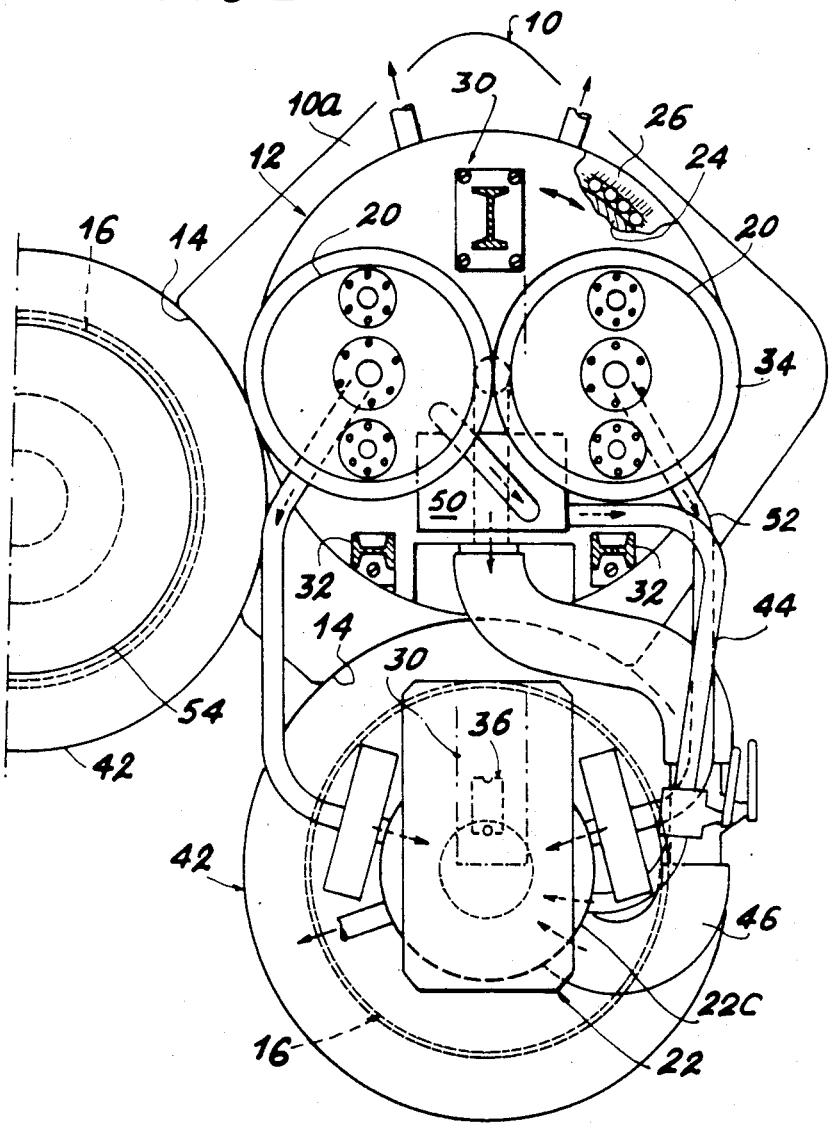
FIG. 2 is a plan view of the device of FIG. 1.

Fixed stand 10 comprises a base plate 10*a* resting on the ground and having circular arc-like recesses 14 (FIG. 2), in which can be placed barrel 16 for receiving coated products. The recesses 14 are arranged in such a way that the axes of the barrel 16 placed in the recesses are located on the same cylinder of revolution of axis XX'. In the represented embodiment, only two recesses 14 are formed on base plate 10*a*, but it is readily apparent that there can be more recesses, if it is wished to place more than two barrels simultaneously in the machine.

Stand 10 also comprises a cylindrical ferrule 10*b*, whose axis coincides with the vertical axis XX' and which supports in a rotary manner the turret 12 by its upper rim.

The mobile turret 12 comprises a dosing pot 18, in which are dosed and provisionally stored the ion exchange resins to be coated, two dosing pots 20 being used for the dosing and provisional storage of the resin and the coating hardener, a kneading head 22, as well as flexible tubes 44, 46, 52 connecting each of the dosing pots to said coating head and which will be described in greater detail hereinafter.

More specifically, the mobile turret 12 comprises a supporting cover 24 mounted in rotary manner via a ballbearing in a ring 26 fixed in a dismantleable manner, e.g. by screws on an upper rim of cylindrical ferrule 10*b*. The assembly constituted by the fixed stand 10 and the rotary cover 24 thus forms a biological protection enclosure, in which is received the dosing pot 18 for provisionally storing the resin, which it is wished to coat.

The dosing pot 18 is suspended on rotary cover 24 by a skirt 28 designed to act as a retaining means in the case of a leak. Preferably skirt 28 is equipped with a moisture detector (not shown). The rotary plug 24 acts as a base for a support beam 30 and a gantry 32, on which are suspended by means of flanges 34 the dosing pots 20 for dosing and provisionally storing the resin and the coating hardener.

By its end placed in overhanging manner beyond the cylindrical ferrule 10*b*, support beam 30 supports the kneading head 22. More specifically, the end of support beam 30 is provided with a loose pulley 36, over which passes a cable 38, to the lower end of which is attached head 22, the other end of cable 38 being fixed to the rod of a jack 40, whose body is integral with the support beam 30.

The arrangement described hereinbefore, by rotating turret 12 about its vertical axis XX', makes it possible to bring the kneading head 22 alternately above each of the barrels 16 received in recesses 14, the operation of jack 40 having the effect of moving head 22 between an upper position permitting the rotation of the turret and a lower position in which the kneading head is coupled to the corresponding barrel.

The kneading head 22 and the barrel 16 are constructed in the manner described in French patent application No. 84 00543, filed on 3.1.1984 by Mr. Henri Lumpp for a "Device For Coating Particles". Reference should be made to the latter for a detailed description of these elements. To provide a satisfactory understanding of the invention, it is merely pointed out that the kneading head 22 essentially comprises a geared motor 22*a* able to rotate, via an electromagnetic coupling 22*b*, a vertical shaft 16*a* equipped with blades 16*b* and arranged within each of the barrels 16.

The kneading head 22 also comprises a plug 22*c*, which seals the upper face of the barrel and has passages into which issue the tubes connected to pots 18 and 20.

When the kneading head 22 is coupled to a barrel 16, cover 22*c* completes the biological protection thereof, which is also ensured by a transportation shell 42 in which the barrel is located.

Figure 3:
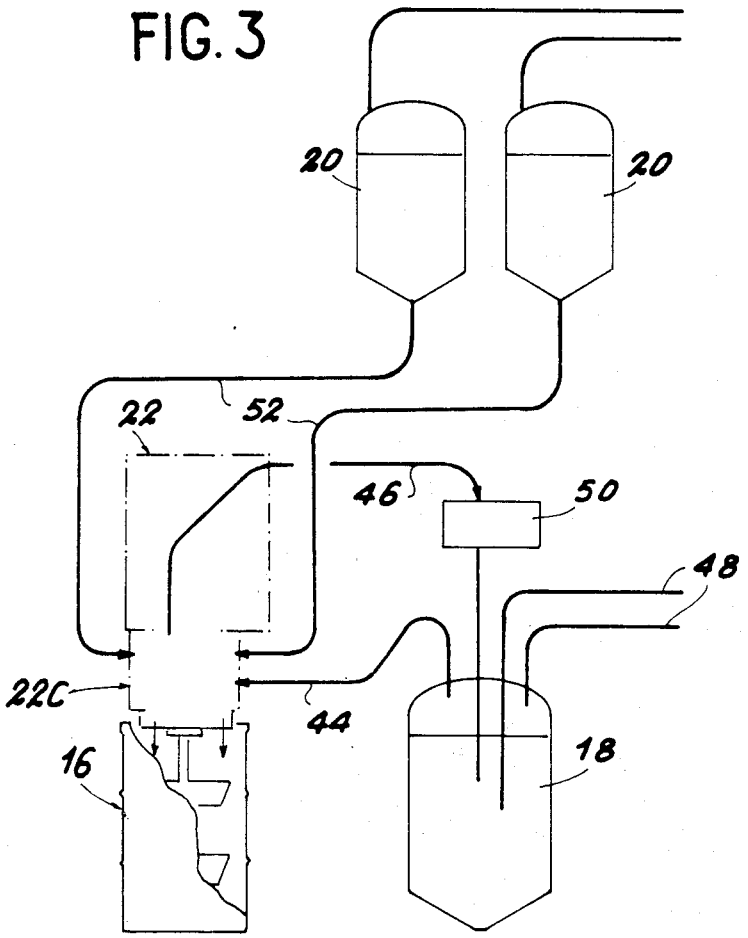
FIG. 3 is a side view diagrammatically showing the tubes connecting the containers and kneading head of the device of FIGS. 1 and 2.

As is more particularly illustrated by FIG. 3, an outward tube 44 and a return tube 46 connect the dosing pot 18 containing the resin to be coated to the plug of kneading head 22. These tubes 44, 46, as well as tubes such as 48 used for supplying the resin to be coated to dosing pot 18 traverse the rotary plug 24.

The resin and the water with which it is mixed are transferred into barrel 16 by tube 44 and through head 22 by siphoning and under the action of the compressed air injected into pot 18. Drying of the resins transferred into barrel 16 is then carried out by tube 46, which for this purpose is provided with a pump 50. For more details concerning the transfer operations, reference should be made to French patent application No. 84 13935, filed on 11.9.1984 by Technicatome.

Each of the dosing pots 20 respectively containing the resin and the coating hardener is connected to the plug of kneading head 22 by a tube 52, the transfer of the resin and then the hardener taking place by compressed air action.

During the drying phase of the resin to be coated, as well as during the injection of the coating resin and the hardener, the stirring system constituted by shaft 16*a* and blades 16*b* operates through the action of the kneading head motor 22*a*.

When these operations are ended, the electromagnetic coupling 22*b* is operated in order to disengage head 22 from the kneading member 16*a* within the barrel. Head 22 is then raised by the operation of jack 40.

The kneading head 22 can then be brought above another barrel 16 placed in another recess 14 of stand 10 by the rotation of turret 12 about its vertical axis XX'. This operation can be carried out either manually with the aid of a pole or by adding a known motorization system (not shown) to the device.

As is more particularly illustrated by FIGS. 4 and 5, to ensure that the prolonged opening of the barrel in which coating has taken place does not lead to excessive risks for operators, a plug 54 is placed on said barrel as quickly as possible.

Preferably, the device according to the invention is equipped for this purpose with a second support beam 56 supported in a pivotable manner by the first support beam 30 about a vertical axis displaced with respect to axis XX' in the direction of kneading head 22. Like support beam 30, support beam 56 supports plug 54 via a cable 58, which e the plug between an upper position and a lower position under the action of a jack (not shown).

The articulation axis of support beam 56 on support beam 30 is positioned in such a way that the plug can be fitted on the barrel as soon as the kneading head 22 has left the opening thereof under the action of the rotation of the turret 12.

Obviously the invention is not limited to the embodiment described in exemplified manner hereinbefore and in fact covers all variants thereof.

Thus, as has been stated, the invention is not limited to a mobile coating device like that described with reference to the drawings, but can be used in all cases where mixing of the same products has to be carried out successively in several barrels, which particularly occurs in the chemical industry. It is therefore obvious that all the features of the device described linked with the dangerous and toxic nature of the products handled (particularly the biological protection structure) can be eliminated when the treated products do not have these characteristics. Moreover, the number of barrels which can be moved alongside the machines can exceed two without passing beyond the scope of the invention. Furthermore, the number of pots on the mobile turret can be of a random nature equal to or greater than two. Finally, the invention is applicable no matter what the volume of the products to be mixed, the dimensions of the installation and particularly the dosing pots and barrels, being suitable for the treatment of both small and large quantities.

What I claim is:

1. A mobile mixing device for at least two products coming from storage containers in barrels equipped with internal kneading means, which can be rotated by a kneading head, via a disconnectable coupling, when a plug of said kneading head seals said barrels, wherein the device comprises a fixed stand having two receptacles able to receive the barrels and a turret supported by the stand, so that it can rotate about a vertical axis, said turret having the storage containers, the kneading head, at least one tube connecting each of the storage containers to at least one passage provided in said plug and means for vertically displacing the kneading head between an upper position permitting a rotation of the turret in order to bring the said head successively above each of the barrels placed in the receptacles of the stand and a lower position in which the kneading means of the corresponding barrel are connected to the kneading head by said coupling.

2. A device according to claim 1, wherein the fixed stand comprises a base plate, in which are formed the said receptacles and a cylindrical ferrule, whose vertical axis coincides with the rotation axis of the turret and in which one of the said containers is received.

3. A device according to claim 2, wherein the turret is supported by the upper edge of the cylindrical ferrule and has a rotary cover sealing the ferrule and on which is suspended the container received in the ferrule.

4. A device according to claim 1, wherein the kneading head is suspended on a support beam by a flexible fastening, on which act the means for vertically displacing the kneading head.

5. A device according to claim 1, wherein the turret also has means for handling a barrel cover, making it possible to replace the kneading head by said cover, when said head is freed from the corresponding barrel by a rotation of the turret.

6. A device according to claim 5, wherein the barrel cover handling means comprise a second support beam supported in pivotable manner about a vertical axis, displaced towards the kneading head with respect to the rotation axis of the turret.

* * * * *